US007326452B1

(12) United States Patent
Vargas et al.

(10) Patent No.: US 7,326,452 B1
(45) Date of Patent: Feb. 5, 2008

(54) ARTIFICIAL FLOWER WITH INTEGRAL GIFT MEMBER

(76) Inventors: Christina Lynn Vargas, 2955 SW. Varsity La., Port St. Lucie, FL (US) 34953; Michael James Haas, 2200 Winding Creek La., Ft. Pierce, FL (US) 34981

( * ) Notice: Subject to any disclaimer, the term of this patent is extended or adjusted under 35 U.S.C. 154(b) by 0 days.

(21) Appl. No.: 11/512,141

(22) Filed: Aug. 29, 2006

(51) Int. Cl.
*A41G 1/00* (2006.01)
*A45C 11/04* (2006.01)

(52) U.S. Cl. ..... 428/23; 428/12; 428/15; 428/19; 428/542.2; 206/6.1

(58) Field of Classification Search ..... 428/21, 428/22

See application file for complete search history.

(56) References Cited

U.S. PATENT DOCUMENTS

| | | | | |
|---|---|---|---|---|
| 696,631 | A * | 4/1902 | Goetz | 220/743 |
| 1,631,631 | A | 6/1927 | Gerlinger | |
| 1,870,208 | A * | 8/1932 | Crosser | 431/125 |
| 2,876,587 | A | 3/1959 | Saks et al. | |
| 2,874,267 | A | 4/1959 | Shipley | |
| 5,082,699 | A | 1/1992 | Landau | |
| 5,407,712 | A * | 4/1995 | D'Allura | 428/22 |
| D390,498 | S | 2/1998 | Reichert | |
| 6,244,554 | B1 | 6/2001 | Baker | |
| 7,043,875 | B1 * | 5/2006 | Neuner | 47/41.15 |
| 2004/0129665 | A1 | 7/2004 | Cavan | |

FOREIGN PATENT DOCUMENTS

| | | | |
|---|---|---|---|
| JP | 07-215281 | * | 8/1995 |

* cited by examiner

*Primary Examiner*—Jennifer C. McNeil
*Assistant Examiner*—Gordon R. Baldwin
(74) *Attorney, Agent, or Firm*—Hayworth Chaney & Thomas, PA; Stephen C. Thomas; Robert A. Lynch

(57) ABSTRACT

An artificial flower which contains an integral gift is disclosed. The integral gift enhances the value and appeal of the artificial flower, or likewise enhances the appeal of an arrangement of such artificial flowers. The invention relates to an artificial flower, or an arrangement of a plurality of such flowers, containing an adapter for holding a small gift member, and a gift member. The scope of the invention includes the artificial flower, adapter, and gift member. The gift member may be selected from a number of special, or thematic, items such as miniature beverage bottles, golf balls, cigars, gift boxes, jewelry, or any gift items.

4 Claims, 6 Drawing Sheets

ARTIFICIAL FLOWER WITH INTEGRAL GIFT MEMBER

BACKGROUND

The invention relates to an artificial flower which contains an integral gift member. More particularly, the invention relates to an artificial flower with an integral gift member comprising an artificial flower, an adapter for holding gift member, and a gift member. The gift member can be any one of a number of special, or thematic, items such as miniature bottles of a beverage, golf balls, cigars, gift containers, jewelry, or any other small items.

Flowers are often given as gifts to recipients on special occasions, or at times thought to be appropriate by the giver. Flowers are also often utilized for decoration. Flowers are often utilized in arrangements that may include various types of greenery, various types of flowers, or combinations of each. Natural flowers and greenery are often utilized for such gifts; however, natural flowers are subject to a number of undesirable features. Natural flowers have a limited lifetime, and the recipient must dispose of natural flowers after they have begun to decay. Artificial flowers are therefore often utilized instead of natural flowers. Such artificial flowers may be fabricated from silk, plastic, fabric, nylon, rubber, or other materials. Artificial flowers are well known in the art.

Whether natural or artificial flowers are utilized as gifts or decoration, they are typically viewed as simply decorative in nature. The value and appeal of a gift of flowers is usually based upon the recipient's reaction to the type of flower chosen, the quality of the flowers presented, and the beauty of the arrangement. These valuations on the part of the recipient are subjective in nature and difficult to anticipate, creating a problem for the giver. As the flower arrangements typically given are generally acquired at a cost to the giver, the giver would benefit from being able to tailor the flower arrangement to the intended recipient based upon knowledge of the recipient's habits, hobbies, likes, and other personal information, and thereby eliminate the uncertainty of whether the recipient will appreciate and enjoy the particular flower arrangement chosen by the giver.

In light of these difficulties, givers are usually left with limited options available to provide some tailoring of the flowers for a particular recipient, such options usually being limited to the type of flowers chosen or the style of the floral arrangement. Such options for tailoring the flowers are typically not specific to a particular recipient, with the result that the giver often gives a gift of flowers that are not specifically tailored to the particular recipient.

Floral arrangements are often utilized as gifts for special occasions. Exemplary occasions may range from wedding anniversaries to birthdays and other like special occasions. Furthermore, floral arrangements are often utilized to provide decoration for gatherings and are thus used as decorative table center pieces, for example. Exemplary gatherings include banquets, weddings, parties, awards ceremonies, and the like. It is often desired that the floral arrangements utilized as gifts or table center pieces contain elements of design such that a specific theme is emphasized based upon a particular event or circumstance. For instance, an awards ceremony for a golf tournament may have table center pieces incorporating a golf theme. Likewise, a gift of flowers to a spouse or significant other may incorporate miniature bottles of alcohol designed to celebrate an anniversary or other special occasion. The appeal of such floral arrangements is enhanced by adding gift members to such arrangements to provide a theme.

Over the years, there have been proposed various enhancements to arrangements of flowers, gifts, or the like in an attempt to increase the appeal of such items.

U.S. Pat. Application No. US 2004/0129665 by Cavan discloses a figurine attached to a removable cap to be used on a bottle. The cap is to be removed to allow the bottle to be discarded once the contents are emptied. The cap is then utilized as a decorative item.

U.S. Pat. No. 1,631,631 to Gerlinger discloses a table decoration comprising a candle, a metal wire frame which acts as a stabilizing stand, a wire coil for holding the candle, and decorative moss or the like arranged around the candle.

U.S. Pat. No. 2,874,267 to Shipley discloses a candle support for flower holders comprising a tubular-shaped member slidable over a candle gripping the candle, means on the tubular-shaped member for receiving a flower and retaining liquid such a water or nutrient solution, wherein said receiving means is a dovetail groove arrangement. Flowers are thus retained and arranged around the periphery of the candle.

U.S. Pat. No. 2,876,587 to Saks et al. discloses a candlestick flower arranger comprising a cup-shaped candle stick holder and a top member that slides downward over a candle placed in the center of the candle stick holder, said top member having openings circumferentially placed in the top member to receive the stems of flowers.

U.S. Pat. No. 5,082,699 to Landau discloses a floral bottle device comprising an annular coaxial flower display that is placed upon the top of a bottle, such as a wine bottle, and in which stems of flowers are embedded to provide a decorative display. The invention further comprises an interconnecting means for attaching the flower display means to the bottle.

U.S. Pat. No. 696,631 to Goetz discloses a refreshment receptacle and boutonniere comprising a cup mounted into the stem of an artificial flower, said cup receiving refreshment such as sherbets, ices, creams, custards, bonbons, sweetmeats, and other toothsome dainties for use in serving such items to guests. After consuming the refreshment, the guest is able to remove the flower portion of the invention to be used as a souvenir or worn as a boutonniere. The invention of the '631 patent is limited to a single flower and is not suitable for providing small gift items, and it furthermore is not suitable for use in arrangements involving a plurality of flowers.

Accordingly, there remains a need for an invention that enhances the value of a gift of flowers by providing for the securing of a gift member within an artificial flower, is adaptable for use in multiple-flower arrangements, is tailorable to a specific gift recipient or to a specific theme, can be transported and stored in the same manner as the traditional artificial flower, and increases the appreciation of the gift by the recipient.

All patents, patent applications and publications discussed or cited herein are incorporated by reference to the same extent as if each individual publication or patent application was specifically and individually set forth in its entirety.

SUMMARY

The invention fulfills the current need in the art as described above. The invention pertains to a combination of an artificial flower having a stem and petals; a securing means for holding a gift member secured onto the stem of the artificial flower, and a gift member secured onto the flower stem by the securing means and thereby held into the approximate center of the artificial flower. The invention is a useful improvement in the art in that it significantly enhances the appeal of the artificial flowers to the recipient. Further, the presently disclosed invention is tailorable to a specific recipient by the careful selection of the gift-enhancing member chosen to be included in the flower arrangement. The invention also provides a useful and novel improvement upon the art for providing thematic centerpieces and decoration for social events, gatherings, banquets, weddings, gatherings, and the like. The character and nature of the gift member is limited only in that it must fit within the approximate center of the artificial flower, or flowers, and it must be supportable by the artificial flower stem.

Exemplary gift members are a miniature beverage bottle, such as the miniature bottles of consumable alcohol beverages known in the art; golf ball; cigar; small gift box; jewelry; thematic item; or any small item that fits within the approximate center of the artificial flower, or flowers, and is supportable by the artificial flower stem. The securing means may be an adapter mounted onto the stem of the artificial flower and thus located within the approximate center of the flower. The gift member is retainingly engaged to the securing means. In this manner, an artificial flower containing a gift member is realized. An alternate embodiment of the invention is realized by providing a plurality of the invention arranged in a floral arrangement. Such an arrangement may be delivered or presented to the recipient as a gift, or may be utilized for table centerpieces at parties, dinners, banquets, social gatherings, or the like.

While the accomplishment of the above and related benefits of the invention may be embodied in the form illustrated in the accompanying drawings, attention is called to the fact that the drawings are illustrative only. Variations are contemplated as being part of the invention, limited only by the scope of the claims.

DETAILED DESCRIPTION OF THE INVENTION

Figure 1:
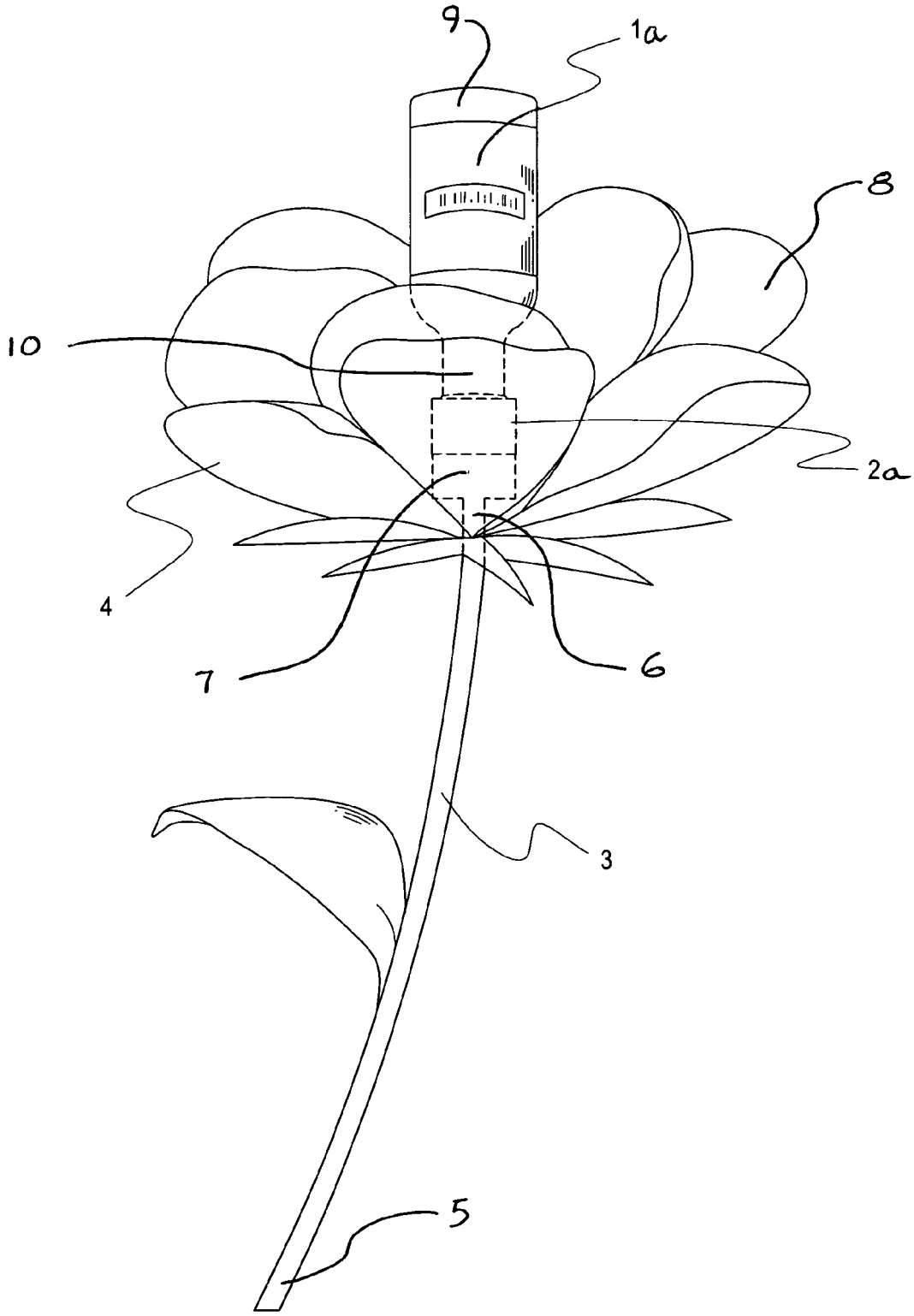
FIG. 1 is a perspective view of an embodiment of the artificial flower and gift-enhancing item, wherein the gift-enhancing item is a miniature beverage bottle.

The present invention comprises a combination of an artificial flower, or a plurality of artificial flowers; a securing means for securing a gift member into the center of an artificial flower; and a gift member secured in the artificial flower by said securing means. The combination enhances the appeal of the flower or flower arrangement. The artificial flowers may be fabricated from any material commonly utilized and known in the art for such items, including but not limited to silk, fabric, nylon, plastic, or other materials known in the art of making artificial flowers. The artificial flower is comprised of a stem having a lower end and an upper end; and a plurality of petals secured to the stem in any of the means known in the art for producing artificial flowers.

The gift enhancing member is captured and held within the approximate center of the flower by a securing means located in the center of the flower. Said securing means may be provided by an adapter, or may be provided by a cup feature provided on the upward end of the flower stem. A plurality of flowers with gift members may be arranged in a floral arrangement, which provides the advantage of providing a plurality of flowers and gift members to the recipient. When a plurality of flowers with gift members are thus provided, an additional advantage is realized in that each individual flower and gift member need not be identical; thus, a plurality of different gift members may comprise the invention. In this manner, for instance, the invention may comprise a plurality of flowers, a portion of which may contain miniature beverage bottles, a portion may contain golf balls, and a portion may contain another type of gift member, thus providing a diversity of gift member in the plurality of flowers of the invention. The design of the invention enables the recipient to remove the gift-enhancing item without destroying the flower, or plurality of flowers, thus allowing the artificial flowers to be used later for any purpose.

Under the scope of this invention, the gift member secured in the artificial flower is any item small enough to fit within the center of the artificial flower and be supported by the artificial flower stem. Exemplary gift members are a miniature beverage bottle; a golf ball; a cigar; a small gift box; or any other small gift which fits into the center of an artificial flower and can be supported by the artificial flower stem. The breadth and scope of the invention is not limited by the exemplary gift enhancing items disclosed herein. For instance, arrangements of the invention may comprise gift members adhering to a theme. An example of such thematic gift members is an embodiment of the invention wherein the gift members are Christmas ornaments. Likewise, the invention may be tailored for any holiday banquet, sports banquet, awards ceremony, or other thematic social event or gathering may utilize the invention by simply placing an appropriately themed gift member in the artificial flower, or flowers. Thus, the breadth and scope of the invention is intended to include any small gift enhancing item which is able to fit within the artificial flower and be supported by the stem and securing means.

Referring now to FIG. 1, an embodiment of the invention is shown wherein the gift-enhancing item is a miniature beverage bottle. The artificial flower is comprised of petals 8 secured to a stem 3 in any manner known in the art and wherein stem 3 has an upper end 6 and a lower end 5. Stem 3 may further have a stem cup 7, as is common the art. Adapter 2 is retainingly engaged by press fit into stem cup 7, and furthermore adapter 2*a* retains cap end 10 of miniature beverage bottle 1, which has also has a bottom end 9. Press fit is commonly utilized in the mechanical arts for the securing of one member to another in a snug fashion. In the present invention, said press fit is configured such that the members are retainingly engaged and are not separable by the normal forces of handling of the item.

Figure 2:
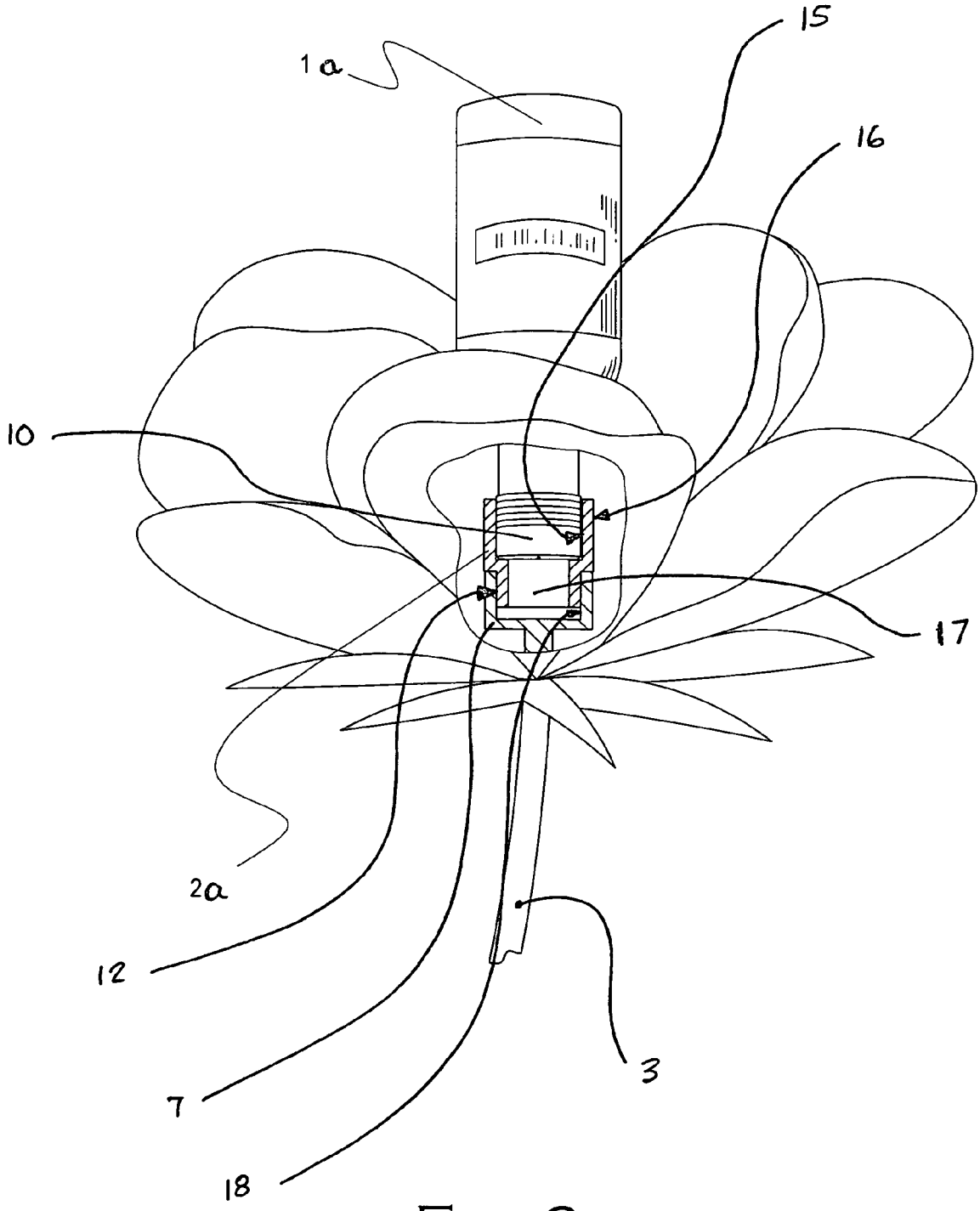
FIG. 2 is cutaway view of an embodiment of the artificial flower and gift-enhancing item, wherein the gift-enhancing item is a miniature beverage bottle.

FIG. 2 depicts a cutaway view of the embodiment of the invention wherein the gift member is a beverage bottle 1*a*, showing further detail of securing means 2*a*. Securing means 2*a* is shown in sectional view as an adapter having a lower portion 17 having an outer surface 12; and having an upper portion 16 having an inner surface 15; wherein the upper portion 16 and lower portion 17 are both circular in cross section. Referring further to FIG. 2, stem 3 has a cup 7 which is shown in cross section and is circular in cross section, having an inner surface 18. Adapter 2*a* is retainingly engaged in stem cup 7 by press fit between adapter outer surface 12 and stem cup inner surface 18, and coaxial alignment between adapter 2*a* and stem cup 7 is thus realized. Gift member 1*a*, a miniature beverage bottle, has a cap portion 10 which is circular in cross section, as is known in the art, and having an outer surface. Said outer surface of gift member cap portion 10 is releasably secured to securing means adapter 2*a* by a slight press fit between cap outer surface and the inner surface 15 of upper portion 16 of securing means adapter 2*a*. Gift member 1*a* can thus be removed from the artificial flower by applying a slight pulling force on gift member 1*a* and pulling it away from securing means 2*a*.

Figure 3:
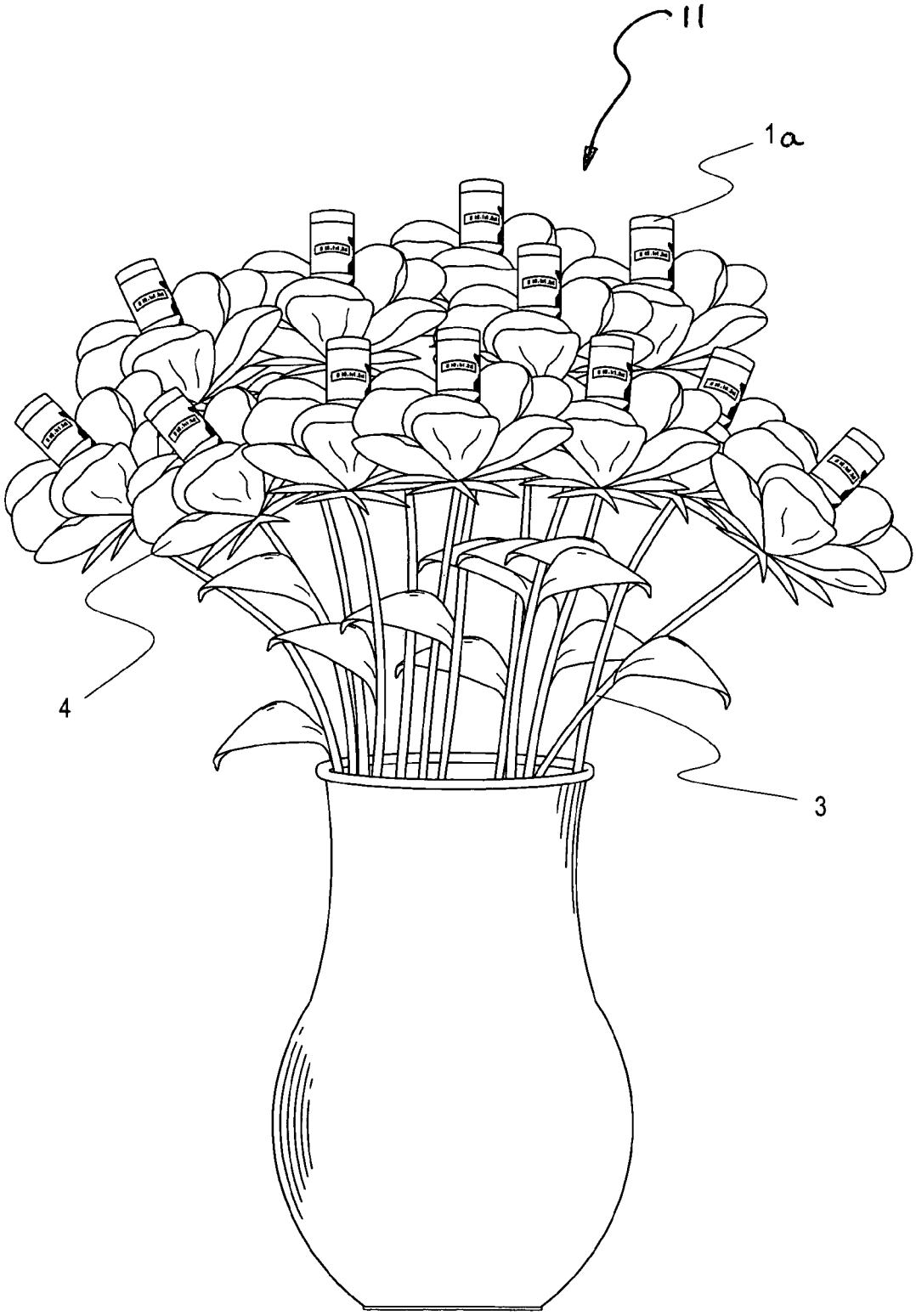
FIG. 3 is an illustration of an arrangement of a plurality of artificial flowers, each containing an exemplary gift-enhancing item.

FIG. 3 shows an embodiment of the invention wherein a plurality of artificial flowers as shown in FIG. 1 and FIG. 2 are arranged in a floral arrangement, each artificial flower having a stem 3, petals 4, securing means, and gift member 1*a*. While gift member 1*a* is shown in the embodiment of the invention depicted in FIG. 3, it understood to be within the scope and breadth of the invention that any gift member small enough to fit within the approximate center of the flower and be supported by stem 3, including but not limited to the gift members disclosed herein, may comprise the invention. In this manner, the scope of the invention includes a plurality of artificial flowers comprising miniature beverage bottles; golf balls; cigars; gift boxes; jewelry; or any other gift member which fits within the artificial flower and is supported by the stem and securing means.

Figure 4:
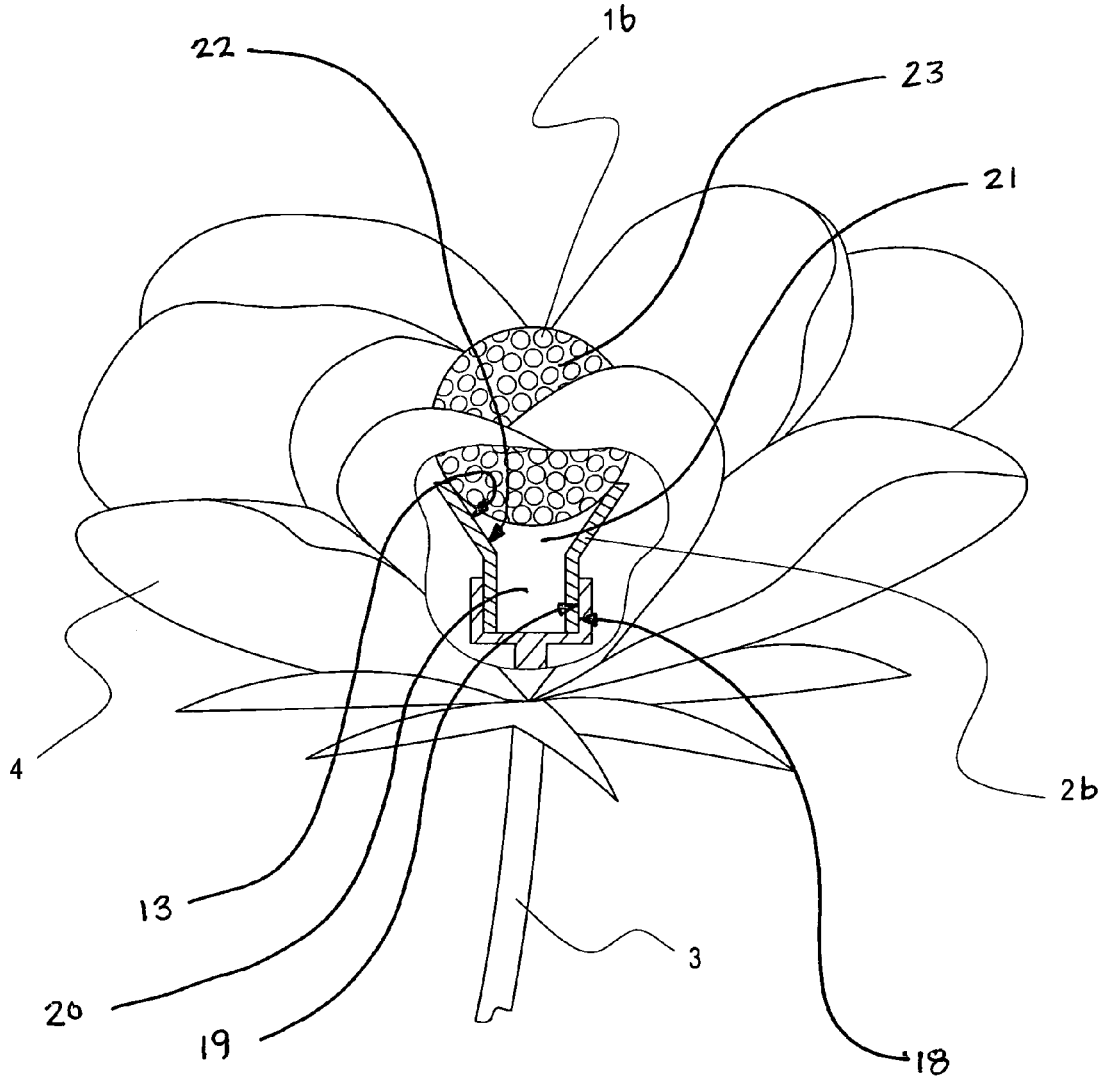
FIG. 4 is a cutaway view of an embodiment of the artificial flower, adapter, and gift-enhancing item, wherein the gift-enhancing item is a golf ball.

FIG. 4 depicts an embodiment of the invention wherein the gift member is a golf ball 1*b*. Securing means is shown in cross sectional view as an adapter 2*b* having an upper conical-shaped portion 21 having an inner surface 22; and a lower portion 20 which is circular in cross section and having an outer surface 19. Gift member golf ball 1*b* is spherical in shape having an outer spherical surface 23. Stem 3 has a stem cup 7 which is circular in cross section and has an inner surface 18. Said securing means adapter outer surface 19 is retainingly engaged by press fit with inner surface 18 of stem cup 7. Gift member 1*b* is releasably retained into securing means adapter 2*b* by adhesive means for example glue, double-sided sticky tape, or the like, said adhesive means being in contact with inner surface 22 of securing means adapter 2*b* and also in contact with outer spherical surface 23 of gift member 1*b*.

Figure 5:
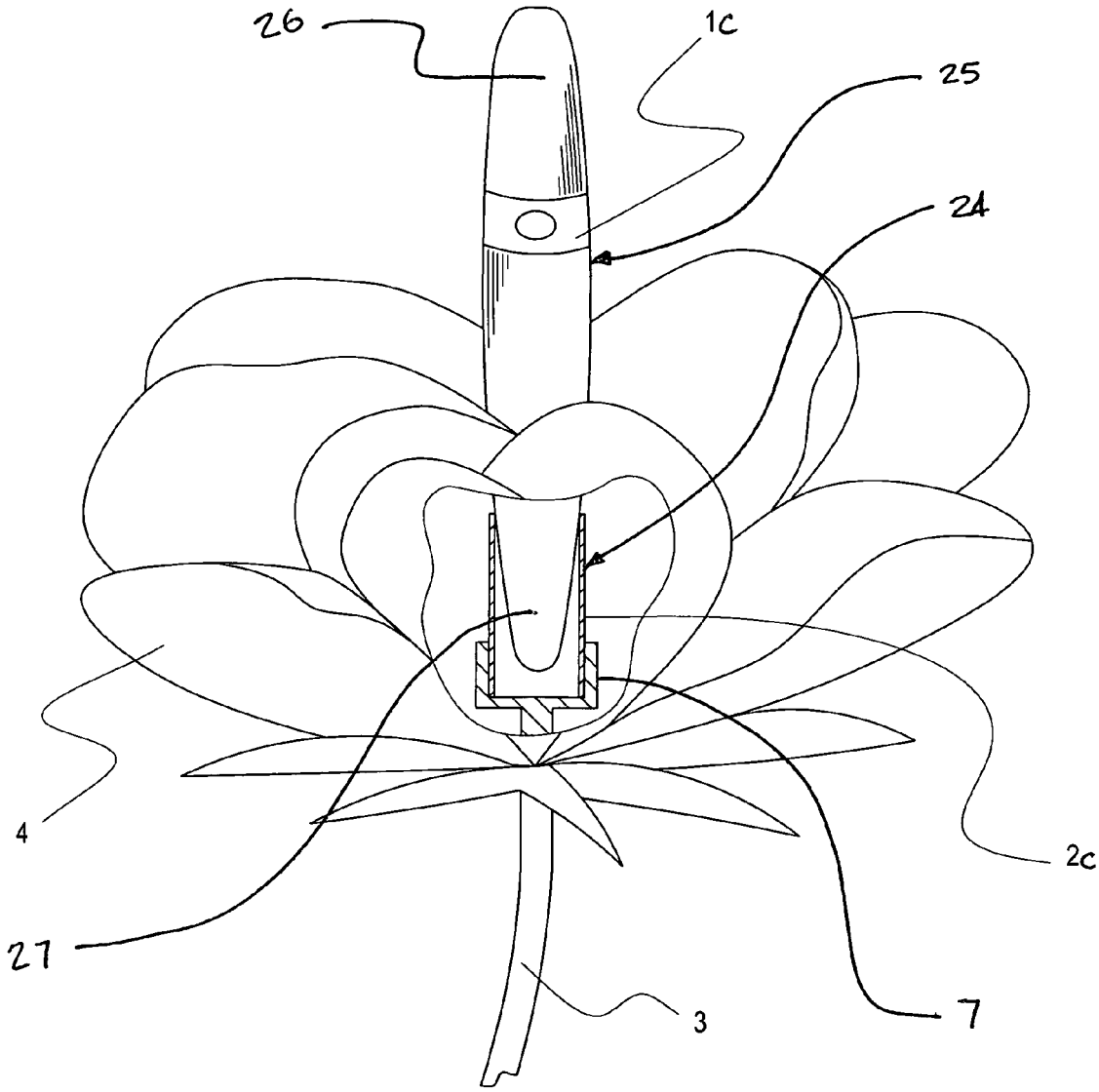
FIG. 5 is a cutaway view of an embodiment of the artificial flower, adapter, and gift-enhancing item, wherein the gift-enhancing item is a cigar.

FIG. 5 depicts an embodiment of the invention wherein the gift member is a cigar 1*c*. Securing means is shown in cross sectional view as an adapter 2*c* which is cylindrical in shape, has a circular cross section and has an outer surface 24. Gift member 1*c* is a cigar which has an outer surface 25 and an upper end 26 and a lower end 27. Stem 3 has a stem cup 7 which is circular in cross section and has an inner surface 18. Said securing means adapter outer surface 24 is retainingly engaged by press fit with inner surface 18 of stem cup 7. Gift member 1*c* is releasably retained into securing means adapter 2*c* by press fit.

Figure 6:
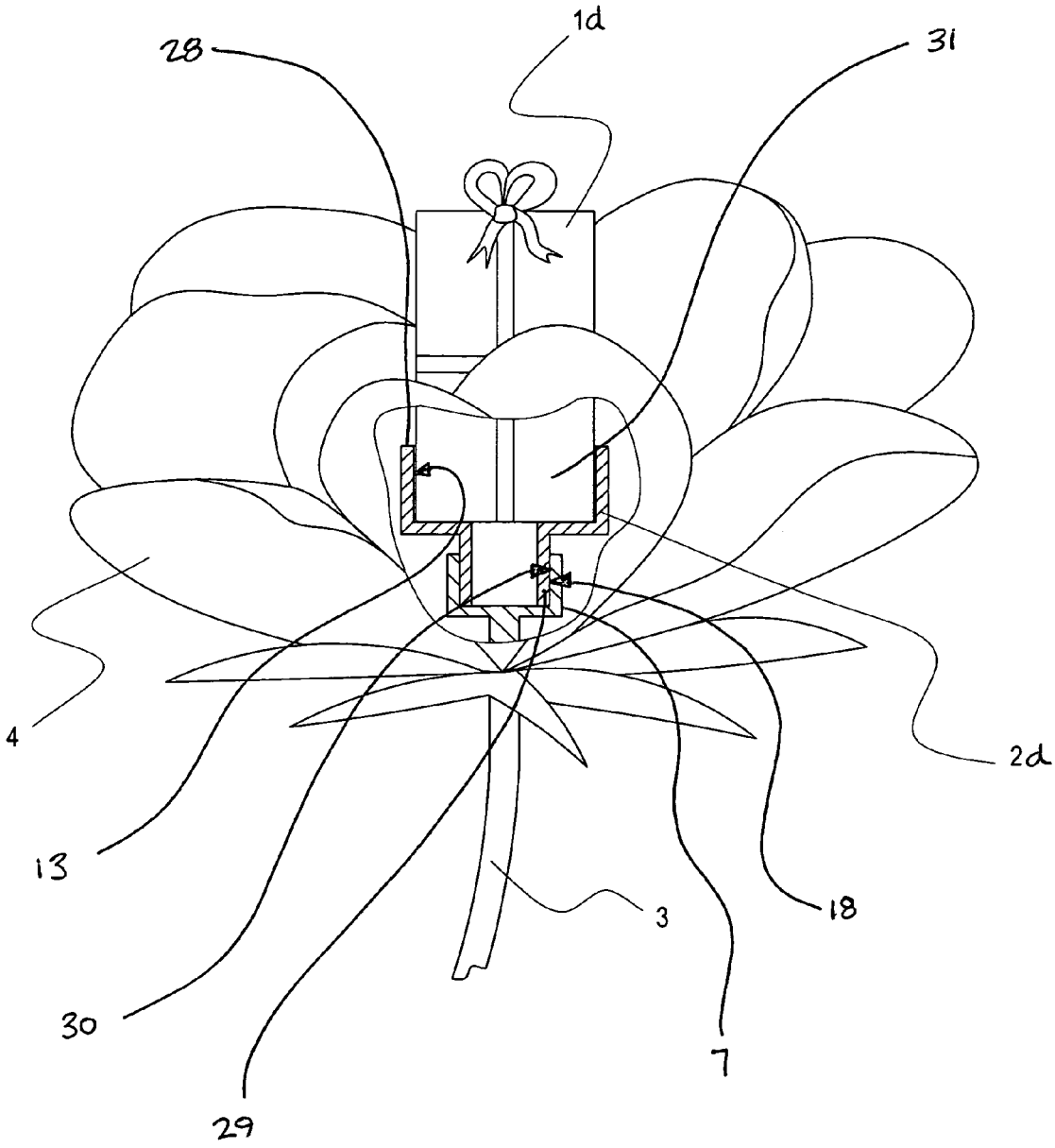
FIG. 6 is a cutaway view of an embodiment of the artificial flower, adapter, and gift-enhancing item, wherein the gift-enhancing item is a gift box.

FIG. 6 depicts an embodiment of the invention wherein the gift member is a gift box 1*d*. Gift box 1*d* may further contain a gift secured within it. Securing means is shown in cross sectional view as an adapter 2*d* having an upper portion 28 which may be circular, square, or rectangular in cross section and which has an inner surface 13; and having a lower portion 29 which is circular in cross section and has an outer surface 30. Gift member 1*d* may be circular cross section, square cross section, or rectangular cross section, and has an outer surface 31. Stem 3 has a stem cup 7 which is circular in cross section and has an inner surface 18. Said securing means adapter outer surface 30 is retainingly engaged by press fit with inner surface 18 of stem cup 7. Gift member 1*d* is releasably retained into securing means adapter 2*d* by press fit with securing means inner surface 13, or by adhesive means for example glue, double-sided sticky tape, or the like, said adhesive means being in contact with inner surface 13 of securing means adapter 2*d* and also in contact with outer surface 31 of gift member 1*d*.

Artificial stem 3 may have artificial leaves in any embodiment of the invention.

The securing means adapter of the invention may be fabricated from materials including but not limited to plastic, nylon, polypropylene, rubber, and the like. Artificial flower petals and leaves may be fabricated from silk, plastic, fabric, and the like as is well known in the artificial flower art. In any embodiment, said securing means may be secured into stem cup 7 by press fit, or, alternatively, by chemical bonding.

Accordingly, it will be seen that this invention provides for securing a gift member into an artificial flower, and is furthermore a relatively simple, lightweight and economical means for providing a gift of a flower, or flowers, with the additional gift member. Referring now to FIG. 1, once the gift-enhancing member 1 is secured in receptacle 2, the apparatus can be delivered to the recipient, or a plurality of them may be utilized, for instance, as a gift or as floral arrangement for table center pieces for gatherings such as parties, weddings, banquets, or other gatherings.

While the figures of the drawings depict securing means as item 2*a*, 2*b*, 2*c*, or 2*d*, it is understood that the scope of the invention includes the embodiment of the invention wherein the securing means is stem cup 7, and thus no adapter is utilized. This embodiment of the invention is appropriate in the embodiments wherein the gift member is able to be releasably secured in stem cup 7 by either press fit or adhesive means, and thus stem cup 7 itself provides said securing means, and no adapter is needed.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An artificial flower with integral gift, comprising:

an artificial flower having an artificial stem and petals, wherein said stem further comprises an upper portion and a lower portion, said upper portion having a cup which is circular in cross section and has an inner surface;

a gift member having an outer surface; and securing means in communication with both said cup and said gift member, said securing means for releasably retaining said gift member into the approximate center of said artificial flower, wherein said securing means is an adapter having an upper and a lower portion, wherein said upper portion has an inner surface and said lower portion is circular in cross section and has an outer surface, wherein said lower portion outer surface is secured by press fit between said adapter lower portion outer surface and said stem cup inner surface; and wherein said gift member releasable retained in said adapter by press fit between said outer surface of said gift member and said adapter lower portion inner surface;

wherein said gift member is releasably retained in the approximate center of said artificial flower by said securing means.

2. The artificial flower with integral gift of claim 1, wherein said gift member is selected from the group consisting of a miniature beverage bottle, a golf ball, a cigar, jewelry, and a small gift box.

3. An artificial flower with integral gift, comprising:

an artificial flower having an artificial stem and petals wherein said stem further comprises an upper portion and a lower portion, said upper portion having a cup which is circular in cross section and has an inner surface;

a gift member having an outer surface; and securing means in communication with both said cup and said gift member, said securing means for releasably retaining said gift member into the approximate center of said artificial flower, wherein said securing means is an adapter having an upper and a lower portion, wherein said upper portion has an inner surface and said lower portion is circular in cross section and has an outer surface, wherein said lower portion outer surface is secured by press fit between said adapter lower portion outer surface and said stem cup inner surface; and wherein said gift member releasably retained in said adapter by adhesive means in contact with said outer surface of said gift member and said inner surface of said adapter upper portion inner surface;

wherein said gift member is releasably retained in the approximate center of said artificial flower by said securing means.

4. The artificial flower with integral gift of claim 3, wherein said gift member is selected from the group consisting of a miniature beverage bottle, a golf ball, a cigar, jewelry, and a small gift box.

* * * * *